US007458829B2

(12) United States Patent
Shioda et al.

(10) Patent No.: US 7,458,829 B2
(45) Date of Patent: Dec. 2, 2008

(54) ELECTRIC CONNECTOR HAVING AN EXCELLENT GROUNDING FUNCTION

(75) Inventors: Tatsuya Shioda, Tokyo (JP); Kazushi Kamata, Aomori (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 26 days.

(21) Appl. No.: 11/593,791

(22) Filed: Nov. 7, 2006

(65) Prior Publication Data

US 2007/0105433 A1 May 10, 2007

(30) Foreign Application Priority Data

Nov. 7, 2005 (JP) ..... 2005-322862

(51) Int. Cl.
*H01R 4/66* (2006.01)
*H01R 13/648* (2006.01)

(52) U.S. Cl. ..... 439/108

(58) Field of Classification Search ..... 439/101, 439/108, 497
See application file for complete search history.

(56) References Cited

U.S. PATENT DOCUMENTS 3,451,393 A 6/1969 Sarnoff
6,129,555 A 10/2000 Daikuhara et al.
6,315,616 B1 11/2001 Hayashi
6,981,898 B2 1/2006 Akama et al.
2004/0235324 A1 * 11/2004 Kimura et al. ..... 439/108

FOREIGN PATENT DOCUMENTS

| | | |
|---|---|---|
| JP | 3451393 | 6/1969 |
| JP | 5-275139 | 10/1993 |
| JP | 3451393 | 10/1999 |
| JP | 2000-067955 | 3/2000 |
| WO | WO 03/065512 | 8/2003 |

OTHER PUBLICATIONS

Japanese Office Action dated Jul. 2, 2008.

* cited by examiner

*Primary Examiner*—Felix O. Figueroa
(74) *Attorney, Agent, or Firm*—Collard & Roe, P.C.

(57) ABSTRACT

For connecting a connection object having first and second surfaces opposite to each other in a first direction, an electrical connector is provided with a ground plate in addition to primary ground contacts and signal contacts. The primary ground contacts are arranged in a second direction, each of which has contact portions which are adapted for contacting with the first and the second surfaces of the connection object, respectively. The signal contacts are arranged in the second direction, each of which has a contact portion for contacting with the first surface of the connection object. Adjacent two of the signal contacts are placed between adjacent two of the ground contacts. The ground plate has a supplementary ground contact which faces a set of the adjacent two of the signal contacts in the first direction and is adapted for contacting with the second surface of the connection object.

10 Claims, 7 Drawing Sheets

ELECTRIC CONNECTOR HAVING AN EXCELLENT GROUNDING FUNCTION

This application claims priority to prior Japanese patent application JP 2005-322862, the disclosure of which is incorporated herein by reference.

BACKGROUND OF THE INVENTION

This invention relates to an electric connector adapted to high-speed transmission.

For the high-speed transmission, a high-speed transmission connector is used. The high-speed transmission connector comprises a socket connector to be connected to a printed circuit board and a plug connector for connecting a flexible printed circuit board (FPC) or a flexible flat cable (FFC) to the socket connector For example, Japanese Patent No. 3451393 (JP-B) discloses a socket connector and a plug connector of the type. The plug connector disclosed in the Japanese Patent comprises an insulator, a connector fitting portion formed at one end of the insulator to be fitted to the socket connector in a first direction, and a FPC fitting portion formed at the other end of the insulator to be fitted to a FPC or a FFC in the first direction. The FPC fitting portion has a plurality of contact groups disposed inside the insulator. Each of the contact groups includes a pair of signal contacts or paired signal contacts arranged in parallel in a second direction intersecting the first direction and a ground contact disposed between the paired signal contacts.

The above-mentioned plug connector has the ground contacts but a sufficient grounding function is not assured. In addition, the plug connector is inevitably increased in size.

SUMMARY OF THE INVENTION

It is therefore an object of this invention to provide an electric connector which is capable of achieving a desired grounding function and has a compact structure.

Other objects of the present invention will become clear as the description proceeds.

According to an aspect of the present invention, there is provided an electric connector to be connected to a connection object having a first and a second surface opposite to each other in a first direction, said electric connector comprising a plurality of primary ground contacts arranged in a second direction perpendicular to the first direction, each of the primary ground contacts having contact portions which are adapted for contacting with the first and the second surfaces of the connection object, respectively, a plurality of signal contacts arranged in the second direction, each of the signal contacts having a contact portion for contacting with the first surface of the connection object, adjacent two of the signal contacts being placed between adjacent two of the ground contacts, and a ground plate comprising a first supplementary ground contact facing a set of the adjacent two of the signal contacts in the first direction, the supplementary ground contact being adapted for contacting with the second surface of the connection object.

DESCRIPTION OF THE PREFERRED EMBODIMENTS

At first referring to FIG. 1, description will be made of an electric connector according to a first embodiment of this invention.

Figure 1:
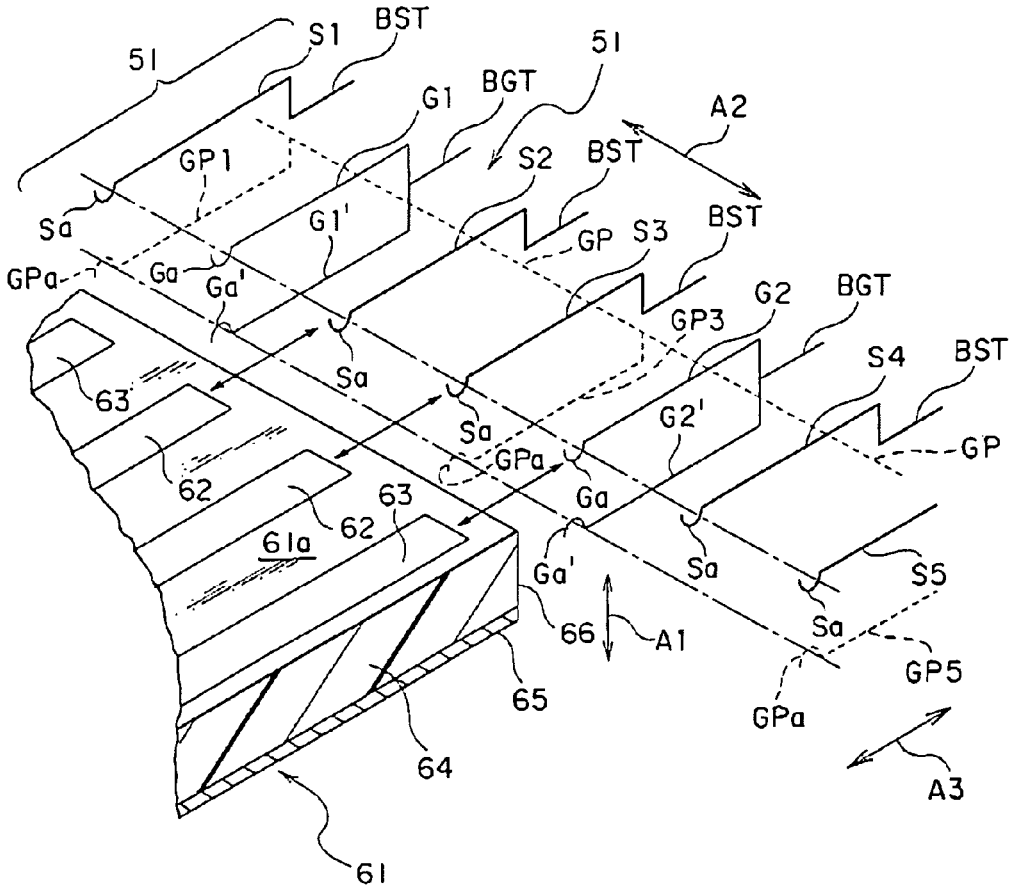
FIG. 1 is a schematic perspective view for describing an electric connector according to a first embodiment of this invention.

FIG. 1 schematically shows a high-speed transmission connector comprises a socket connector 51 as the electric connector and a plug connector 61 which is adapted to be electrically connected to the socket connector 51. The plug connector 61 has a first surface 61*a* and a second surface opposite to the first surface 61*a* in a first direction A1. The plug connector 61 is referred to as a connection object.

Each of the socket connector 51 and the plug connector 61 extends in a second direction A2 perpendicular to the first direction A1. For convenience of illustration, however, only a part of each of the socket connector 51 and the plug connector 61 in the second direction A2 is illustrated in the figure.

The socket connector 51 comprises a plurality of conductive signal contacts S1, S2, S3. S4, and S5, a plurality of conductive ground contacts G1 and G2, and a conductive ground plate GP. Each of the signal contacts S1, S2, S3, S4, and S5 and the ground contacts G1 and G2 is of a cantilevered shape. The signal contacts S1, S2, S3, S4, and S5 have contact portions Sa, respectively. The ground contacts G1 and G2 have contact portions Ga, respectively.

The signal contacts and the ground contacts are arranged in a first row in the order of S1, G1, S2, S3, G2, S4, and S5. The signal contacts S1, S2, S3, S4, and S5 are connected to board connecting terminals BST, respectively. Adjacent ones of the signal contacts (S2 and S3, S4 and S5) are paired and used for differential signal transmission.

The socket connector 51 further comprises a plurality of ground contacts G1' and G2' are faced to the ground contacts G1 and G2 and are arranged in a second row different in height from the first row. The ground contacts G1 and G2 in the first row and the ground contacts G1' and G2' in the second row are connected to each other in a U shape and then connected to board connecting terminals BGT. The ground contacts G1' and G2' have contact portions Ga', respectively.

The ground plate GP has a plurality of ground contacts GP1, GP3, and GP5 of a cantilevered shape. The ground contacts GP1, GP3, and GP5 are arranged in the second row to face the signal contacts S1, S3, and S5, respectively. Each of the ground contacts GP1, GP3, and GP5 has a contact portion GPa facing each of the contact portions Sa of the signal contacts S1, S3, and S5 in the first direction A1.

In the following description, the signal contacts S1, S2, S3, S4, and S5 are collectively depicted by S. The ground contacts G1, G1', G2 and G2' are collectively depicted by G and are referred to as primary ground contacts. Each of the ground contacts GP1, GP3, and GP5 is referred to as a first supplementary ground contact.

Figure 2:
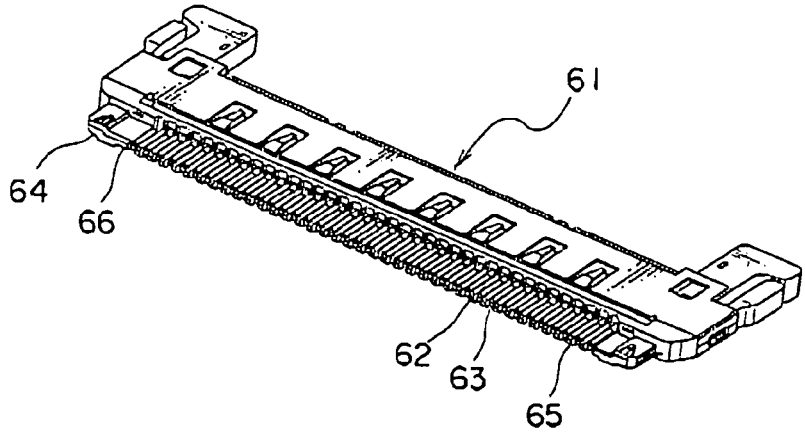
FIG. 2 is a front perspective view of a connector which is adapted to be connected to the electric connector of FIG. 1.

Referring to FIG. 2 in addition to FIG. 1, the plug connector 61 will be described.

The plug connector 61 comprises a plurality of conductive signal contacts 62, a plurality of conductive ground contacts 63, an insulating housing 64 holding the signal contacts 62 and the ground contacts 63, and a conductive shell 65 covering the housing 64.

The plug connector 61 is provided with a fitting portion 66 formed on its front side. On one surface of the fitting portion 66 of the plug connector 61, a plurality of contacts to be connected to the signal contact S and the ground contact G, i.e., signal contacts 62 and ground contacts 63 are disposed. On the other surface of the fitting portion 66 of the plug connector 61, the conductive shell 65 is disposed to be connected to the ground contacts G and the ground contacts GP1, GP3, and GP5.

Referring to FIGS. 3 to 7, a structure of the socket connector 51 will be described in detail.

Figure 3:
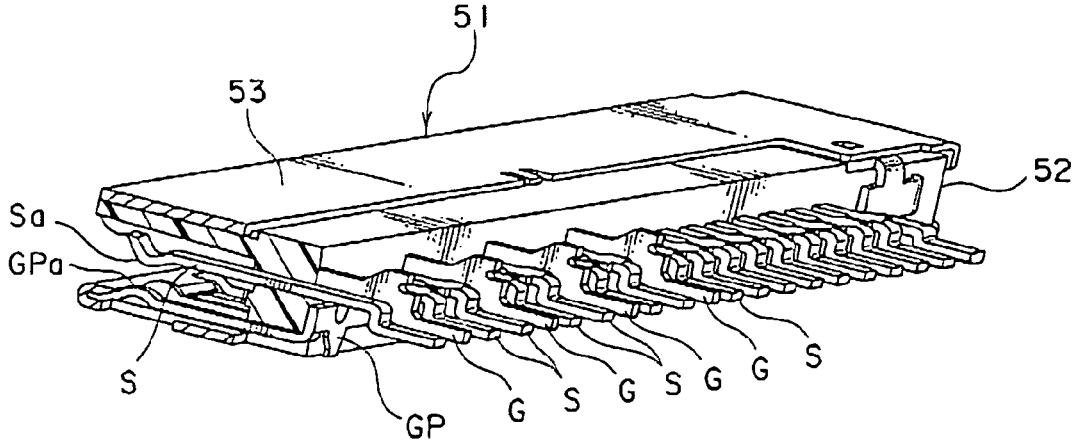
FIG. 3 is a sectional rear perspective view of the electric connector in FIG. 1.
Figure 4:
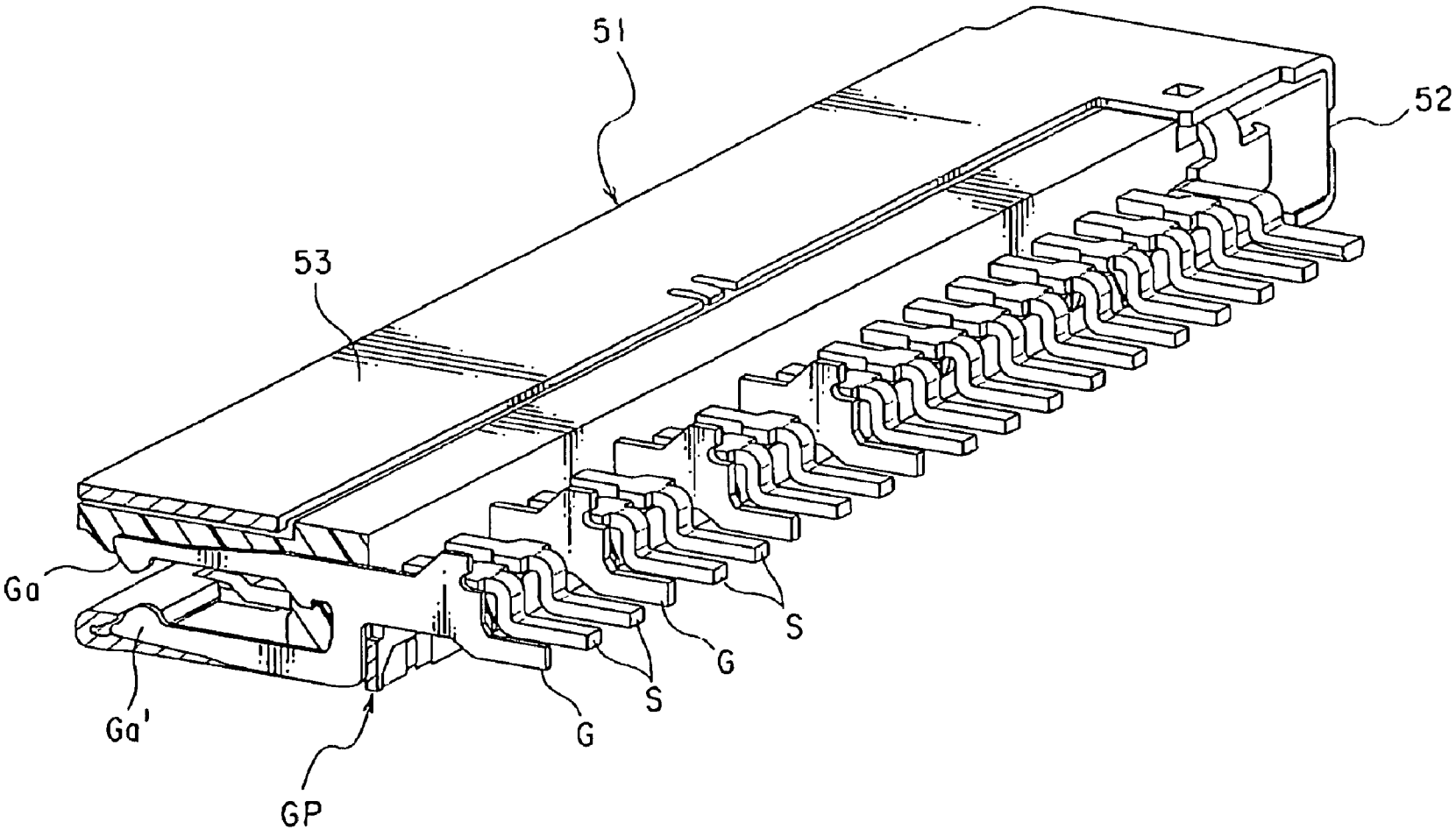
FIG. 4 is a enlarged sectional rear perspective view of the electric connector of FIG. 1, cut at a position different from that in FIG. 3.
Figure 5:
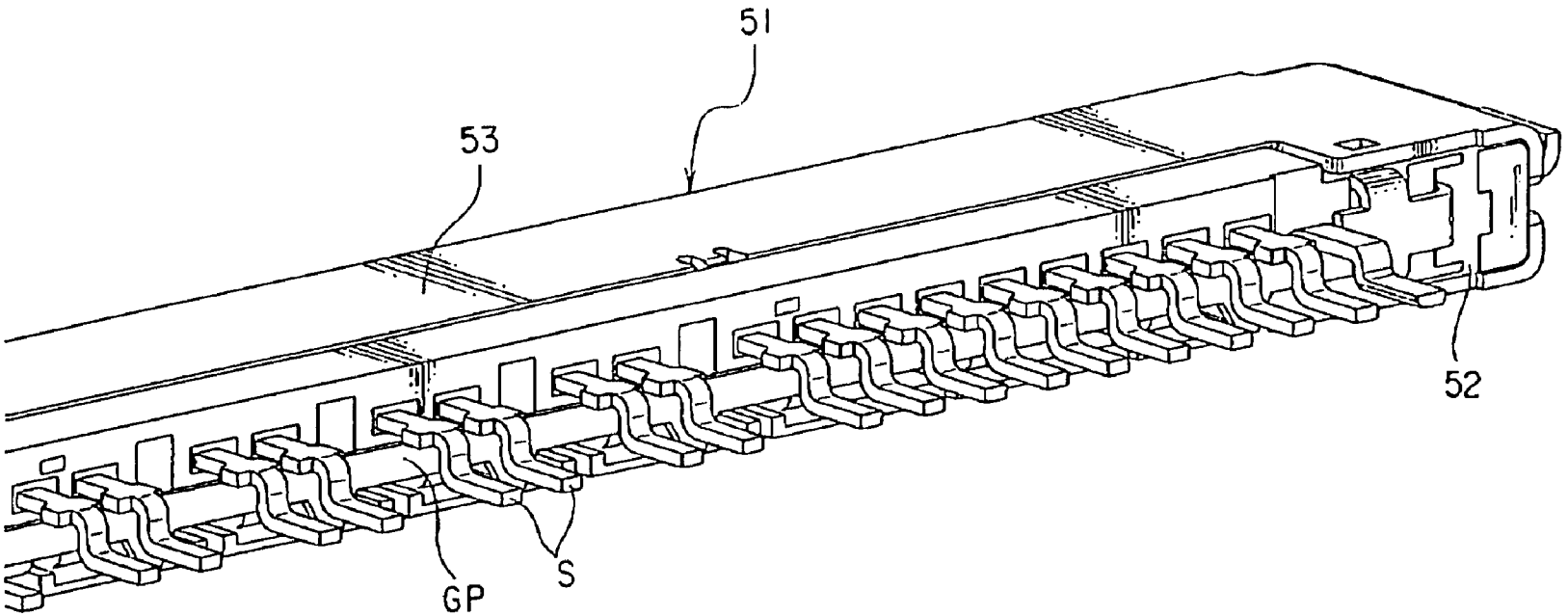
FIG. 5 is a rear perspective partial view of the connector of FIG. 1 in the state where ground contacts are removed.

In FIGS. 3 to 5, the signal contacts S and the ground contacts G are held by an insulating housing 52. The ground contacts G are arranged at a specific range of the socket connector 51 in the second direction A2. It is noted here that the ground contacts G are not formed in the vicinity of one of longitudinal ends of the socket connector 51. The housing 52 is covered with a conductive shell 53, together with the ground plate GP.

Figures 6, 7:
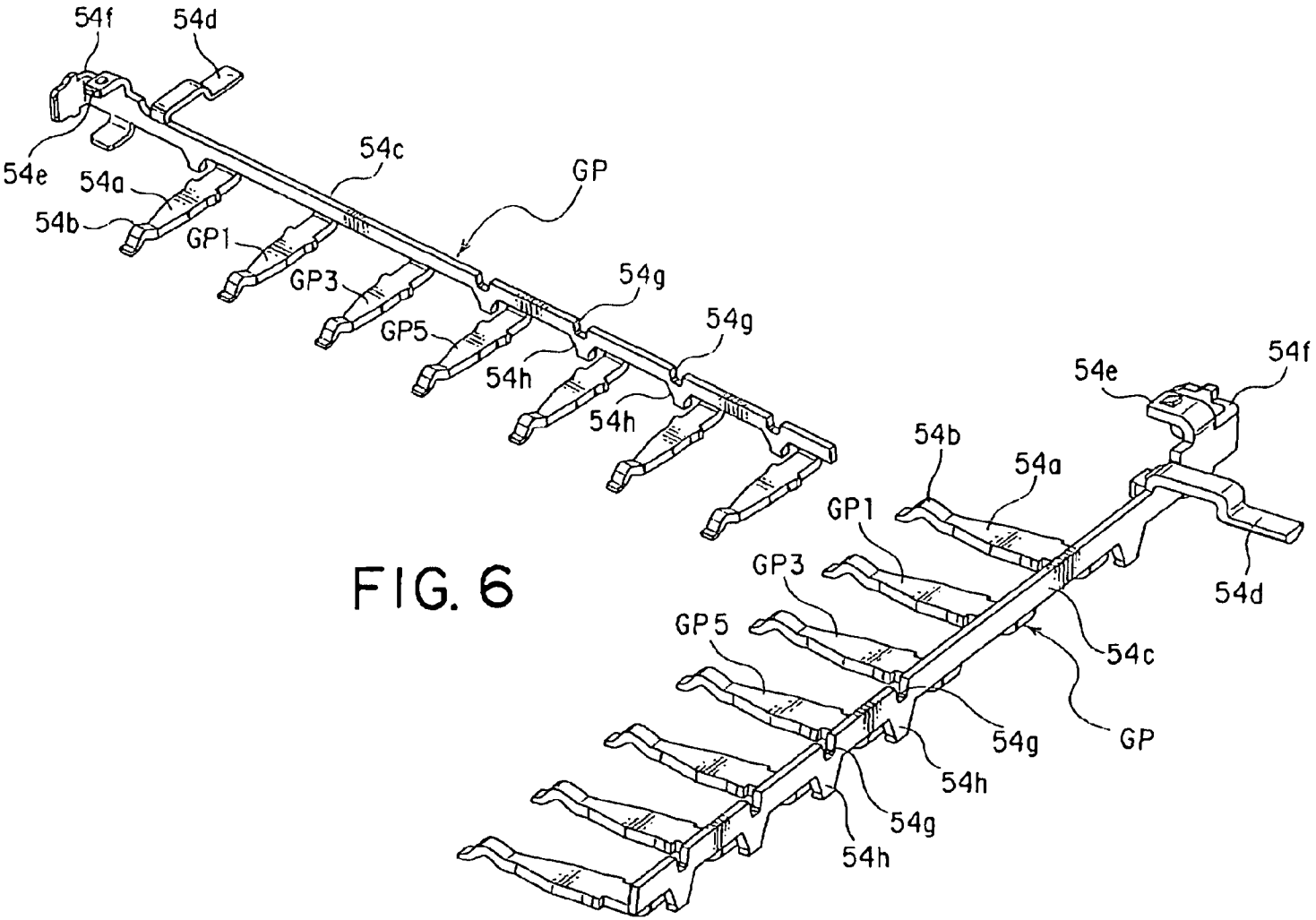
FIG. 6 is a front perspective sectional view of a ground plate included in the electric connector illustrated in FIG. 1.
FIG. 7 is a rear perspective sectional view of the ground plate of FIG. 6.

In FIGS. 6 and 7, the ground plate GP includes a number of contact base portions 54*a* having contact point portions 54*b* (corresponding to GPa), a connecting portion 54*c* from which the contact base portions 54*a* are bent downward and forward at a predetermined pitch, a pair of soldering terminal portions 54*d* formed near opposite ends of the connecting portion 54*c* and bent upward and rearward from the connecting portion 54*c*, a pair of fixing portions 54*e* formed near the opposite ends of the connecting portion 54*c* and bent upward and frontward therefrom, and a pair of fixing portions 54*f* formed at the opposite ends of the connecting portion 54*c* and bent forward therefrom.

A plurality of grooves 549 are formed on an upper side of the connecting portion 54*c*. The grooves 54*g* are arranged at a particular range of the connecting portion 54*c* in the second direction A2. It is noted here that the grooves 549 are not formed in the vicinity of one of longitudinal ends of the connecting portion 54*c*. In the grooves 54*g*, the ground contacts G are fitted or inserted, without contacting, to pass therethrough.

A plurality of strengthening protrusions 54*h* are formed on a lower side of the connecting portion 54*c* in correspondence to the grooves 54*g*, respectively. Each of the ground contacts GP1, GP3, and GP5 of the ground plate GP is formed by the contact base portion 54*a* and the contact point portion 54*b*. The ground contacts GP1, GP3, and GP5 are arranged at an equal pitch. It is preferable that the connecting portion 54*c* is electrically connected to at least one of the ground contacts G.

In the foregoing, the connecting portion 54*c* and the contact base portions 54*a* of the ground plate GP are perpendicularly bent from each other. Alternatively, the connecting portion 54*c* and the contact base portions 54*a* may be linearly arranged without bending.

Turning back to FIG. 1, description will be made of connection of the socket connector 51 and the plug connector 61.

The socket connector 51 is connected to the plug connector 61 in a third direction A3 perpendicular to the first and the second directions A1 and A2. In this event, the fitting portion 66 of the plug connector 61 is clamped between the ground contacts GP1, GP3, and GP5 of the ground plate GP and the signal contacts S1, S3, and S5 and is also clamped between the ground contacts G1 and G2 and the ground contacts G1' and G2'.

As a result, the contacting portions Sa at ends of the signal contacts S1, S2, S3, S4, and S5 are connected to corresponding ones of the signal contacts 62 of the plug connector 61, respectively. Contacting portions GPa at ends of the ground contacts GP1, GP3, and GP5 are connected to the shell 65 of the plug connector 61. Contacting portions Ga at ends of the ground contacts G1 and G2 are connected to the ground contacts 63. Contacting portions Ga' of the ground contacts G1' and G2' are connected to the shell 65.

When the ground contacts G and the ground plate GP are coupled to the housing 52, the ground contacts G may be connected at positions of the grooves 54*g* of the connecting portion 54*c* of the ground plate GP. Namely, the ground contacts G are located at the grooves 54*g*, respectively.

Figure 8:
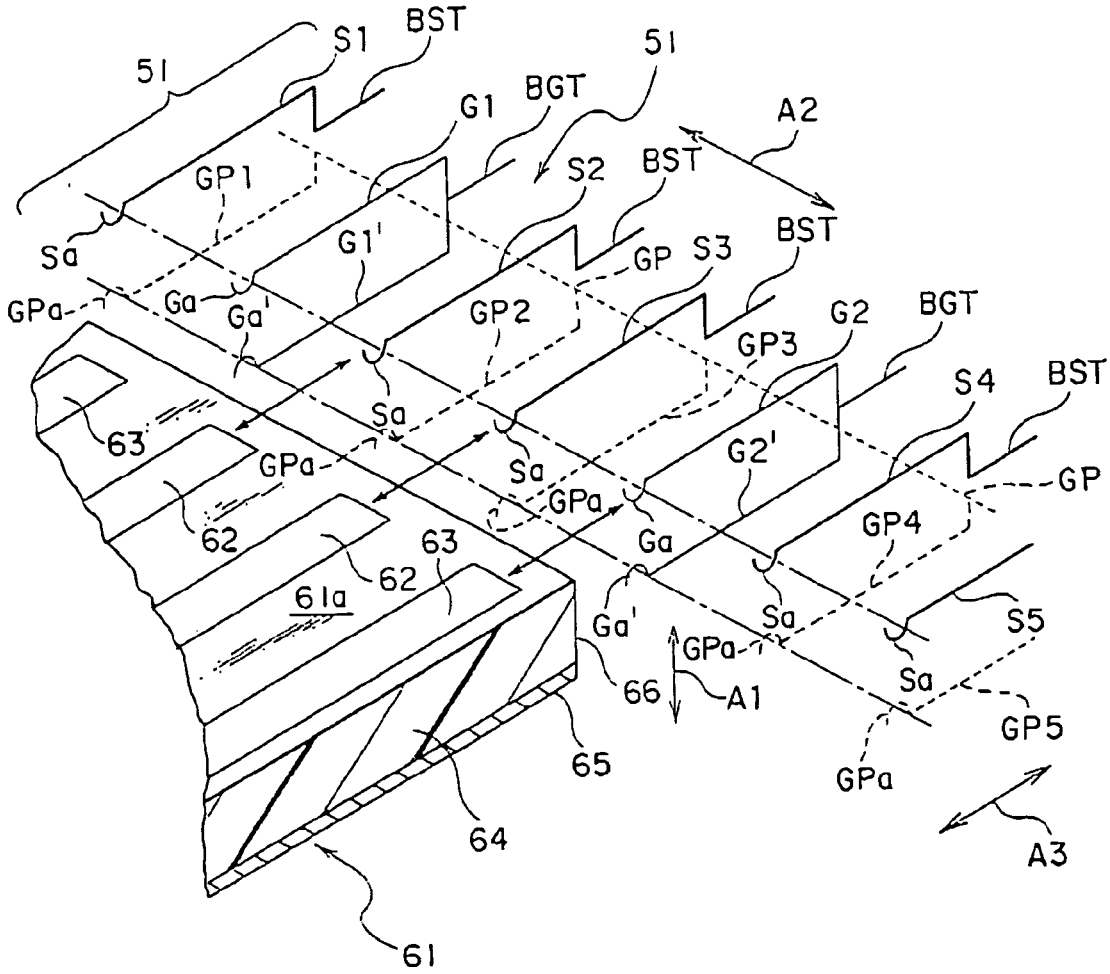
FIG. 8 is a schematic perspective view for describing an electric connector according to a second embodiment of this invention.

Referring to FIG. 8, description will be made of an electric connector according to a second embodiment of this invention. Similar parts are designated by like reference numerals and description thereof will be omitted.

In FIG. 8, a ground plate GP' of the socket connector 51 has, in addition to the above-mentioned ground contacts GP1, GP3, and GP5, a plurality of ground contacts GP2 and GP4 disposed therebetween and having a similar cantilevered shape. The ground contacts GP2 and GP4 are arranged in the second row to face the signal contacts S2 and S4, respectively. When the socket connector 51 is connected to the plug connector 61, the contacting portions GPa at the ends of the ground contacts GP2 and GP4 are connected to the shell 65 of the plug connector 61. Each of the ground contacts GP2 and GP4 will be referred to as a second supplementary ground contact.

Figure 9:
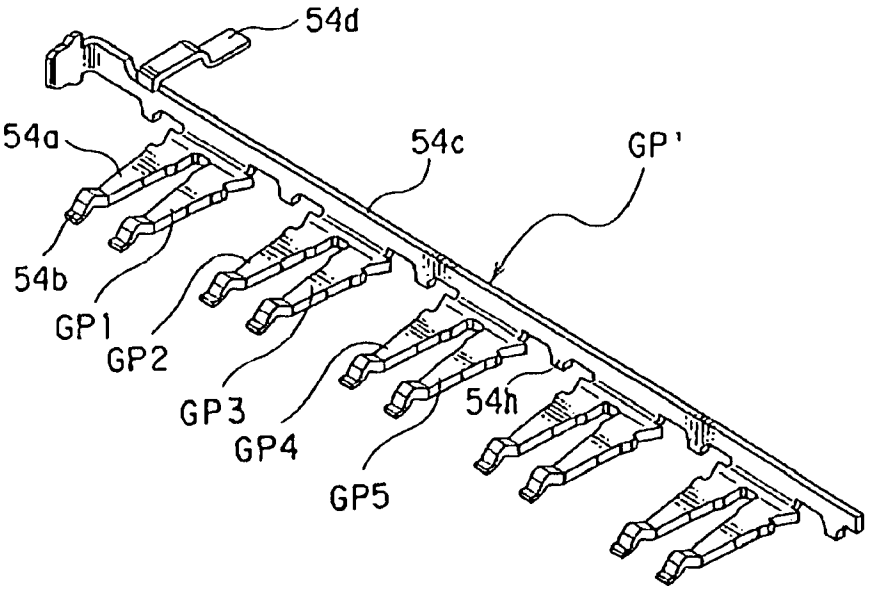
FIG. 9 is a front perspective sectional view of a ground plate included in the electric connector illustrated in FIG. 8.
Figure 10:
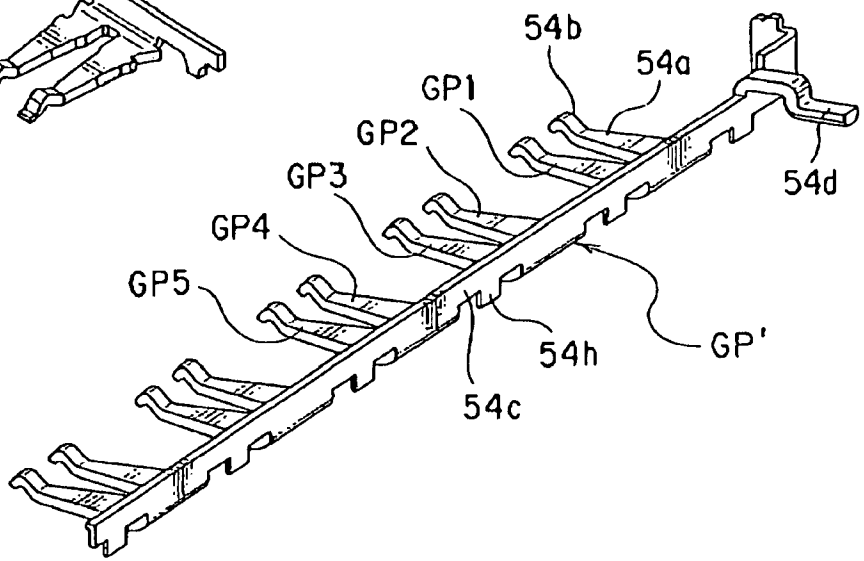
FIG. 10 is a rear perspective sectional view of the ground plate of FIG. 9.

Referring to FIGS. 9 and 10, the ground plate GP' will be described. Similar parts to those of the ground plate GP are designated by like reference numerals and description thereof will be omitted.

In the ground plate GP', every two contact base portions 54*a* are arranged adjacent to each other. Specifically, the ground contacts GP2 and GP3 are closely adjacent to each other as a pair. The ground contacts GP4 and GP5 are adjacent to each other as a pair. Adjacent pairs are spaced from one another at an equal pitch and are relatively distant from one another. Thus, in the ground plate GP', the pitch of the ground contacts GP1 to GP5 is not constant. In this embodiment also, the connecting portions 54*c* and the contact base portions 54*a* of the ground plate GP' are bent from each other. However, the connecting portions 54*c* and the contact base portions 54*a* may be linearly formed without bending.

In the foregoing description, the ground plate GP is formed by a single plate. Alternatively, the ground plate GP may be divided into a plurality of plates. Adjacent ones of a plurality of ground plates GP may be connected by a spring member.

According to each of the socket connectors 51, the following effects are attained.

1. It is possible to provide a connector capable of achieving a desired grounding function and having a compact structure.

2. The ground contacts to be connected to the shell of the mating connector and the ground contacts to be connected to the ground contacts of the mating connector are integrally formed and connected to the board arranged in close proximity. With this structure, a feedback current smoothly flows through the ground and the stability of potential is improved.

While the present invention has thus far been described in connection with a few embodiments thereof, it will readily be possible for those skilled in the art to put this invention into practice in various other manners. For example, although the ground contacts G are arranged only in a part of the socket connector, they may be evenly arranged through all area between both ends of the socket connector. In this case, the grooves 54*g* also are evenly formed through all area between both ends of the ground plate.

What is claimed is:

1. An electric connector to be connected to a connection object having a first and a second surface opposite to each other in a first direction, said electric connector comprising:

a plurality of primary ground contacts arranged in a second direction perpendicular to the first direction, each of the primary ground contacts having contact portions which are adapted for contacting with the first and the second surfaces of the connection object, respectively;

a plurality of signal contacts arranged in the second direction, each of the signal contacts having a contact portion for contacting with the first surface of the connection object, adjacent two of the signal contacts being placed between adjacent two of the ground contacts; and a ground plate comprising a first supplementary ground contact facing a set of the adjacent two of the signal contacts in the first direction, the supplementary ground contact being adapted for contacting with the second surface of the connection object, and a connecting portion extending in the second direction, the connecting portion being formed integral with the first supplementary ground contact and electrically connected to at least one of the primary ground contacts.

2. The electric connector according to claim 1, wherein the first supplementary ground contact faces one of the adjacent two of the signal contacts in the first direction.

3. The electric connector according to claim 2, wherein the ground plate further comprises a second supplementary ground contact facing another of the adjacent two of the signal contacts in the first direction.

4. The electric connector according to claim 3, wherein each of the first and the second supplementary ground contacts has a contact portion facing the contact portion of each of the signal contacts.

5. The electric connector according to claim 1, further comprising a housing, each of the primary ground contacts, each of the signal contacts, and the first supplementary ground contact being held by the housing in a cantilevered configuration.

6. The electric connector according to claim 5, wherein the ground plate further comprises a second supplementary ground contact held by the housing in the cantilevered configuration, the first and the second supplementary ground contacts facing the adjacent two of the signal contacts in the first direction, respectively.

7. The electric connector according to claim 6, wherein the ground plate further comprises a connecting portion extending in the second direction, the first and the second supplementary ground contacts are paired and connected to the connecting portion.

8. The electric connector according to claim 1, wherein the connection portion has a plurality of grooves arranged in the second direction, the primary ground contacts being located at the grooves, respectively.

9. The electric connector according to claim 8, wherein the connection portion has a plurality of strengthening protrusions in correspondence to the grooves by the one to one.

10. The electric connector according to claim 1, wherein the adjacent two of the signal contacts are paired and adapted for differential signal transmission.

* * * * *